US009186541B1

(12) United States Patent
Murray

(10) Patent No.: US 9,186,541 B1
(45) Date of Patent: Nov. 17, 2015

(54) ELLIPTICAL TRAINER

(71) Applicant: Dyaco International Inc., Taipei (TW)

(72) Inventor: Brian Murray, Taipei (TW)

(73) Assignee: Dyaco International Inc., Taipei (TW)

( * ) Notice: Subject to any disclaimer, the term of this patent is extended or adjusted under 35 U.S.C. 154(b) by 0 days.

(21) Appl. No.: 14/461,185

(22) Filed: Aug. 15, 2014

(30) Foreign Application Priority Data

May 22, 2014 (TW) ..... 103208990 U

(51) Int. Cl.
*A63B 22/00* (2006.01)
*A63B 22/06* (2006.01)

(52) U.S. Cl.
CPC ..... *A63B 22/0664* (2013.01); *A63B 2022/067* (2013.01)

(58) Field of Classification Search
USPC ..... 482/1–148
See application file for complete search history.

(56) References Cited

U.S. PATENT DOCUMENTS 7,854,691 B2 * 12/2010 Long ..... A63B 22/001 482/51
2015/0087481 A1 * 3/2015 Liu ..... A63B 22/0664 482/52
2015/0182787 A1 * 7/2015 Liu ..... A63B 22/001 482/52

FOREIGN PATENT DOCUMENTS

TW M403355 U 5/2011
TW M433877 U1 7/2012

* cited by examiner

*Primary Examiner* — Stephen Crow
(74) *Attorney, Agent, or Firm* — Donald E. Stout; Stout, Uxa & Buyan, LLP

(57) ABSTRACT

An elliptical trainer comprises a base, a rotational mechanism, a left and a right coupling mechanism, and a rising device. The rotational mechanism is arranged on the base. The left and right coupling mechanisms are arranged at a side of the rotational mechanism, respectively. One end of the left and right coupling mechanism couples to the rotational mechanism, and the other couples to a pedal making a moving path. The rising device comprises a frame, two guiders, at least a ladder component, and a driving assembly. The driving assembly comprises a motor, a screw, a tube, a linkage component, and a cable. The tube has internal thread to engage with the screw. The linkage component couples with the tube, and the cable couples with the linkage component and the ladder component.

10 Claims, 8 Drawing Sheets

ELLIPTICAL TRAINER

CROSS-REFERENCE TO RELATED APPLICATIONS

The entire contents of Taiwan Patent Application No. 103208990, filed on May 22, 2014, from which this application claims priority, are expressly incorporated herein by reference.

BACKGROUND OF THE INVENTION

1. Field of the Invention

The present invention relates to an exercise device, and more particularly relates to elliptical trainer providing elliptical or elliptical-like exercising paths.

2. Description of Related Art

Without limiting the disclosed embodiments, an elliptical trainer, also called a cross-trainer or an X-trainer, is a stationary exercise machine to simulate stair climbing, walking, or running.

The elliptical trainer does not cause excessive pressure to the joints as the two legs simultaneously share the burden, hence decreasing the risk of impact injuries.

The elliptical trainer typically includes two pedals. A user steps on the pedals and the operation of the elliptical trainer cause the pedals to provide a moving path. For conventional elliptical trainers, the path of the pedals cannot be varied.

FIG. 1 discloses a conventional elliptical trainer with a rising device 10 arranged at its rear portion to vary the moving path of pedals. As shown in FIG. 1, the rising device 10 comprises an automatically control device 13 consisting of a motor 132, a screw 134, and a tube 136 having internal thread to couple with the screw 134. The motor can drive the screw 134 to rotate, causing the tube 136 to move along the screw 134 in a direction leaving the motor 132. Further, a lift member 14 has two ends, in which one end couples to the tube 136 and the other end contact the ground. In addition, a U-shaped member 15 has two ends respectively coupling to a guider 12, and an end of the guider 12 pivotally coupled to an end of a frame 11 near the ground. A connecting member 16 has two ends, in which one end fixes with the U-shaped member 15 and the other end pivotally couples with the lift member 14. Two pedals (not shown) are respectively arranged on the guider 16 via a wheel. When the tube 136 moves away from the motor 132, the lift member 14 exerts a force on the U-shaped member 15, and the guider 12 is hence raised so as to change the moving path of pedals.

Furthermore, Taiwan Patent, Publication No., M403355, entitled "Rising Device for Elliptical Trainers," also discloses an elliptical trainer with a rising device that can adjust the path of the pedals. The entire contents of above-mentioned Taiwan Patent are incorporated herein by reference.

Yet there is still a need for an elliptical trainer that can reduce cost and/or increase stability.

SUMMARY OF THE INVENTION

In one general aspect, the present invention relates to an elliptical trainer, and more particularly relates to an elliptical trainer with low cost and excellent stability.

In an embodiment of the present invention, an elliptical trainer is provided with a base, a rotational mechanism, a left coupling mechanism and a right coupling mechanism, and a rising device. The rotational mechanism is mounted on the base. The left coupling mechanism and the right coupling mechanism are respectively arranged at a side of the rotational mechanism with one end coupled to the rotational mechanism and another end coupled to a left pedal and a right pedal to make a moving path. The rising device comprises a frame, two guiders, at least one ladder component, and a driving assembly. The driving assembly comprises a motor, a screw, a tube, a linkage component, and a cable. The tube has internal thread engaged with the screw. Each ladder component comprises one end coupled with one of the two guiders and another end with a wheel contacting a supporting surface or ground. The linkage component couples with the tube. The cable couples with the linkage component and the ladder component.

In an embodiment, the rising device further comprises a pivot bracket disposed near to an end of the frame, and the pivot bracket has a pivot pivotally coupled with an end of each of the two guiders.

In an embodiment, the cable is made of steel, and when the motor drives the screw to rotate so as to make the tube moving along the screw in a direction approaching the motor, the tube draws the cable via the linkage component and the cable extends to make the wheel moving to the front end of the elliptical trainer, and consequently the ladder component is folded and draws the coupled guiders to a lowest position.

In an embodiment, the cable is made of steel, and when the motor drives the screw to rotate so as to make the tube moving along the screw in a direction leaving the motor, the tube draws the cable via the linkage component and the cable draws the wheel moving to the rear end of the elliptical trainer, and consequently the ladder component is unfolded and lifts the coupled guiders to a highest position.

In an embodiment, the at least one ladder component is arranged at inside of the frame.

In an embodiment, the at least one ladder component is arranged at outside of the frame.

In an embodiment, each ladder component comprises a first portion and a second portion, the first portion has two ends in which one end couples with one of the two guiders and the other end couples with the second portion, the second portion comprises a wheel, and the cable has two ends respectively coupling with the second portion and the linkage component.

In an embodiment, the rising device further comprises a U-shaped structure, and the first portion of each ladder component couples with one of the two guiders via the U-shaped structure.

In an embodiment, the driving assembly further comprises at least a disk arranged between the linkage component and the ladder component for changing the direction of the cable.

DETAILED DESCRIPTION OF THE PREFERRED EMBODIMENT

Figure 1:
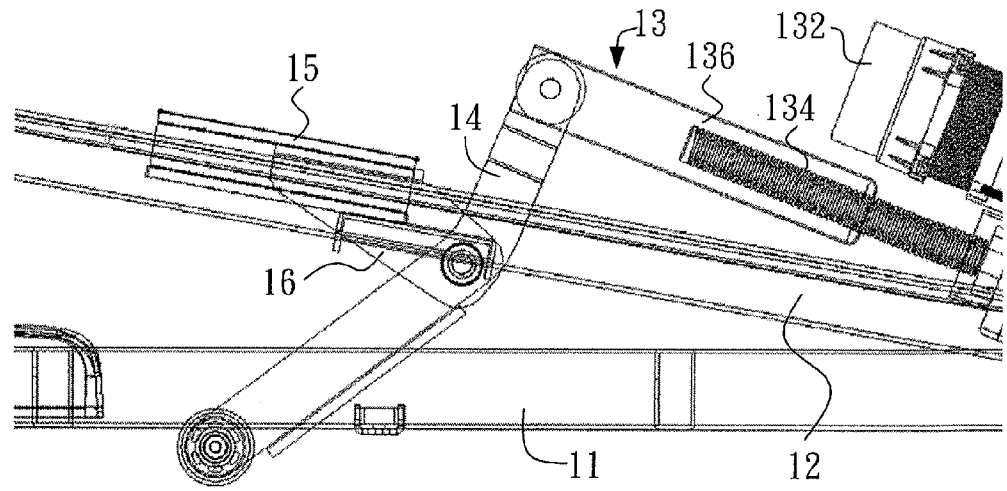
FIG. 1 shows a rising device of a conventional elliptical trainer.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 2:
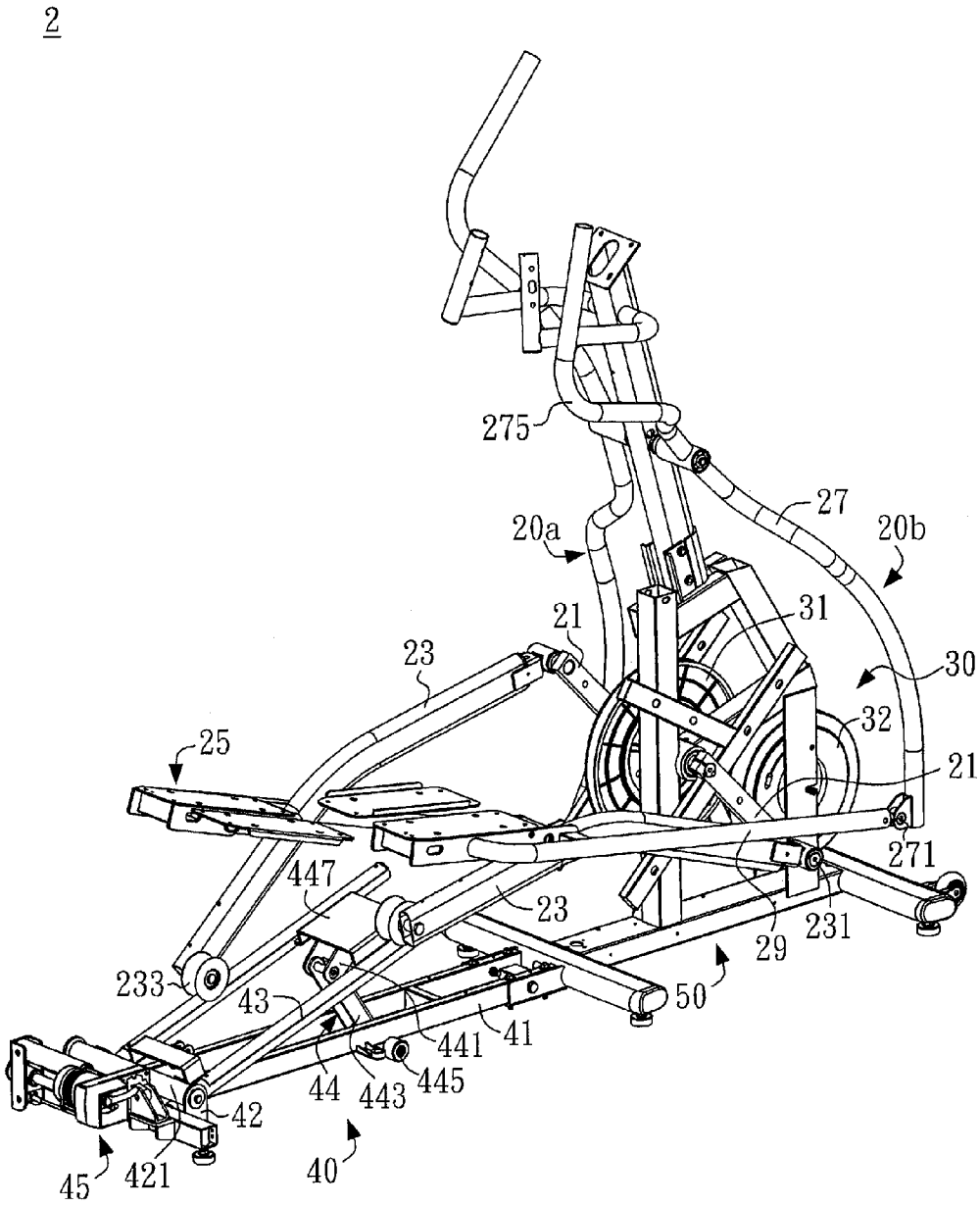
FIG. 2, FIG. 3A, and FIG. 3B are respectively perspective view, side view, and bottom partially enlarged view, showing an elliptical trainer according to a preferred embodiment of the present invention.
Figure 3A:
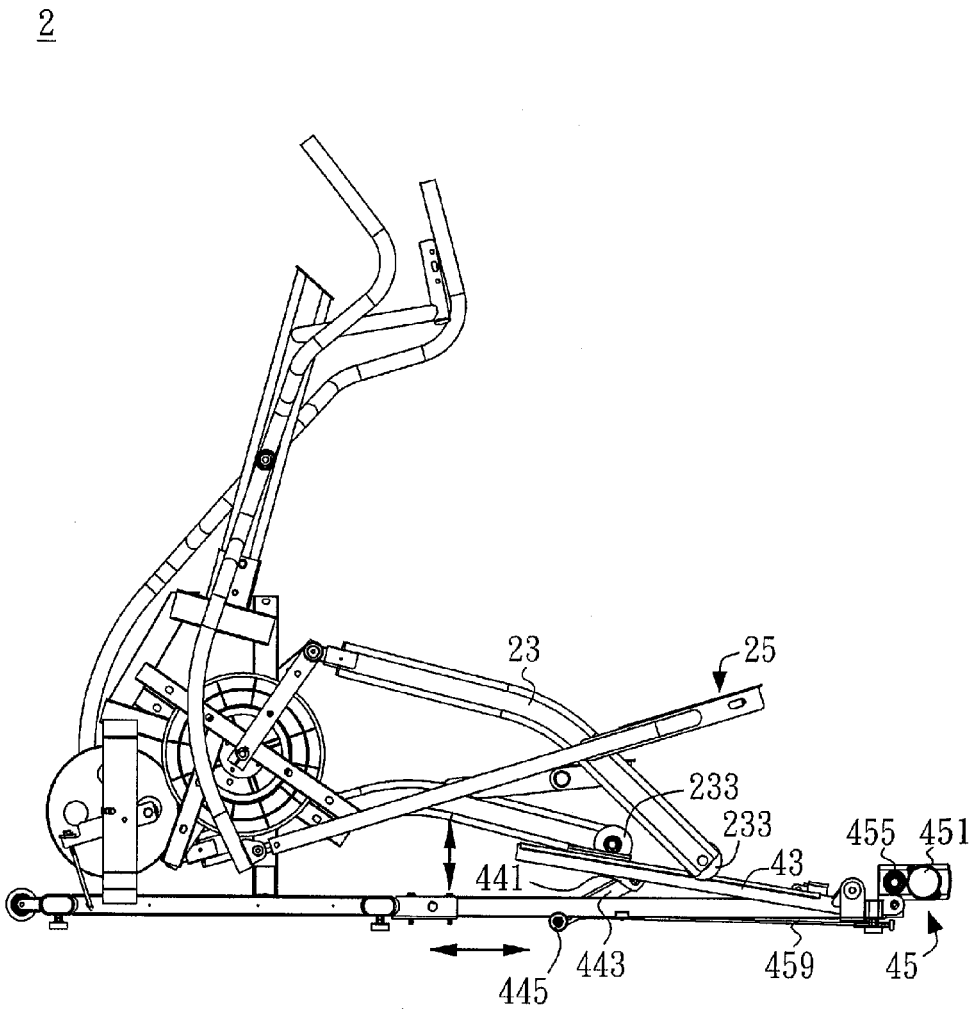
Figure 3B:
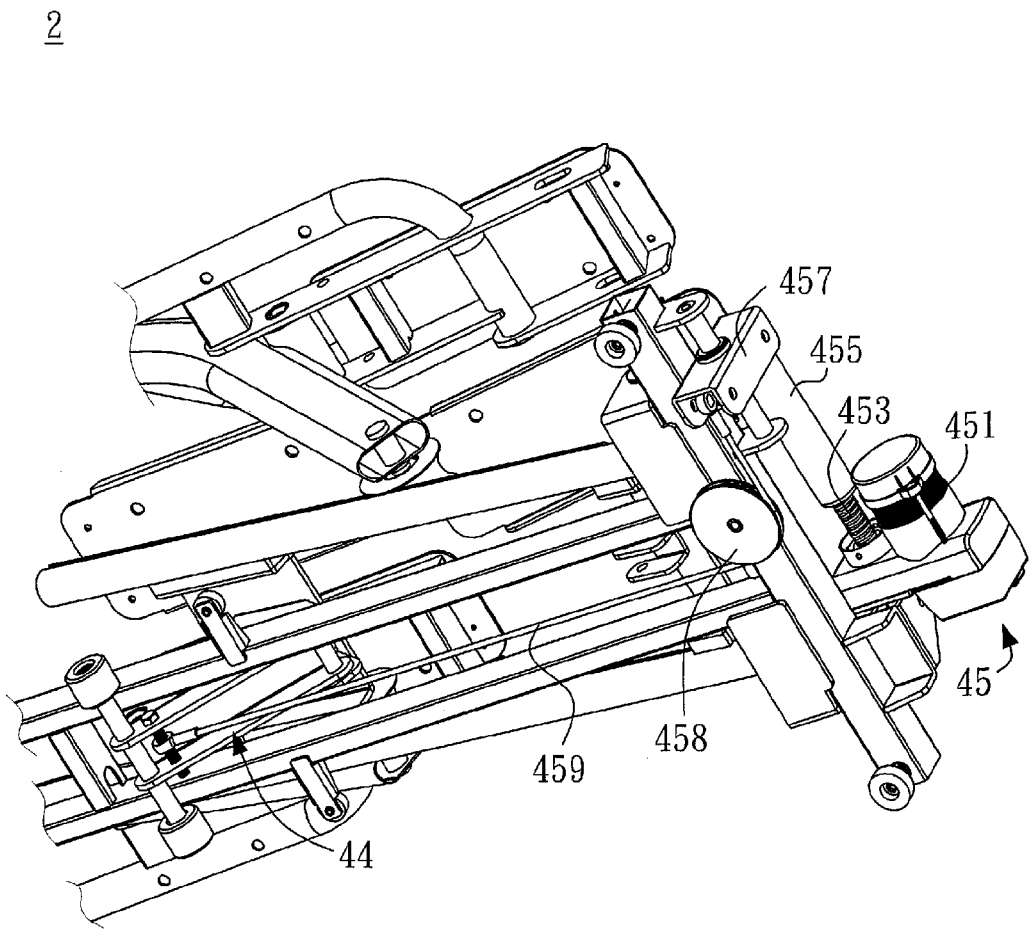

FIG. 2, FIG. 3A, and FIG. 3B show an elliptical trainer 2 according to a preferred embodiment of the present invention, wherein FIG. 2 is a perspective view, FIG. 3A is a side view, and FIG. 3B is bottom partially enlarged view.

As shown in FIG. 2, FIG. 3A, and FIG. 3B, the elliptical trainer 2 comprises a base 50, a left and a right coupling mechanism 20*a*/20*b*, a rotational mechanism 30, and a rising device 40.

The base 50 is arranged on a supporting surface or ground. The left coupling mechanism 20*a* and the right coupling mechanism 20*b* are respectively arranged at a side of the rotational mechanism 30. The left coupling mechanism 20*a* and the light coupling mechanism 20*b* may respectively comprise, but is not limited to, a crank 21, a supporting arm 23, a pedal 25, a handrail 27, and a linkage arm 29.

The rising device 40 may comprise, but is not limited to, a frame 41, a pivot bracket 42, two guiders 43, at least a ladder component 44, and a driving assembly 45.

The supporting arm 23 may comprise a pivot portion 231 and a sliding portion 233. Each crank 21 has two ends, in which one end operatively couples to the rotational mechanism 30, and the other end pivotally couples with the pivot portion 231 of the supporting arm 23. In addition, the sliding portion 233 of the supporting arm 23 can be reciprocally slid on the guider 43. The sliding portion 233 preferably comprises a wheel 233. The supporting arm 23 also couples with the pedal 25.

The handrail 27 may comprise a pivot portion 271 and a holding portion 275. The linkage arm 29 has two ends, in which one end couples the pedal 25, and the other end couples to the pivot portion 271 of the handrail 27. The holding portion 275 is provided to be held by a user, so that the handrail 27 can be operated to swing forward and backward.

The rotational mechanism 30 is arranged on the base 50 and connects with two pedals 25 via the left coupling mechanism 20*a* and the right coupling mechanisms 20*a*/20*b*, respectively. When the user drives the rotational mechanism 30 via the left and right coupling mechanism 20*a*/20*b*, the pedals 25 will make a moving path, e.g., an elliptical or elliptical-like moving path. The rotational mechanism 30 may comprise, but is not limited to, a driving wheel 31 and a flywheel 32.

FIGS. 3A and 3B are side view and bottom partially enlarged view showing the preferred elliptical trainer of the present invention. As shown in FIGS. 2, 3A, and 3B, the rising device 40 may comprise the frame 41, the pivot bracket 42, two guiders 43, at least one ladder component 44, and the driving assembly 45.

The driving assembly 45 may comprise, but is not limited to, a motor 451, a screw 453, a tube 455, a linkage component 457, a disk 458, and a cable 459.

The tube 455 has internal thread engages with the screw 453. The motor 451 can drive the screw 453 to rotate, causing the tube 455 move along the screw 453 in a direction approaching or leaving the motor 451. The tube 455 couples with the linkage component 457. The cable 459 has two ends, in which one end couples with the linkage component 457, and the other end couples with the ladder component 44. The disk 458 is disposed between the cable 459 and the ladder component 44 for varying the direction of the cable 459. The number of disk 458 can be plural in another embodiment of this invention. The cable 459 is preferred made of steel.

The number of the ladder component 44 can be single or plural. The ladder component 44 can be disposed at inside or outside of the frame 41. The ladder component 44 has an upper end and lower end, in which the upper end couples with the two guiders 43, and the lower end has a wheel 443 contacting with the supporting surface or ground.

For illustrative purpose, the ladder component 44 may comprise a first portion 441 and a second portion 443. An upper end of the first portion 441 couples with the guiders 43, and a lower end of the first portion 441 pivotally couples with the second portion 443. Further, a lower end of the second portion 443 has a wheel 443 contacting with the supporting surface or ground. In addition, the first portion 441 may couple with the guiders 43 via a U-shaped structure 447.

The pivot bracket 42 is disposed near the rear end of the frame 41. The pivot bracket 42 includes a pivot 421. Each guider 43 includes an end pivotally couples with the pivot 421, so that the guiders 43 can be rotated around the pivot 421. In this embodiment, the pivot 421 of the pivot bracket 42 is arranged above the supporting surface of the ground. In another embodiment of this invention, the pivot bracket 42 is omitted and the pivot 421 is mounted at the rear end of the frame 41, and the guiders 43 pivotally couple with the pivot 421.

As shown in FIG. 3A, the driving assembly 45 can control the wheel 445 of the ladder component 44 via the cable 459, so that the wheel 445 is moved forward or backward, resulting in a downward or upward movement of the guiders 43.

Figure 4A:
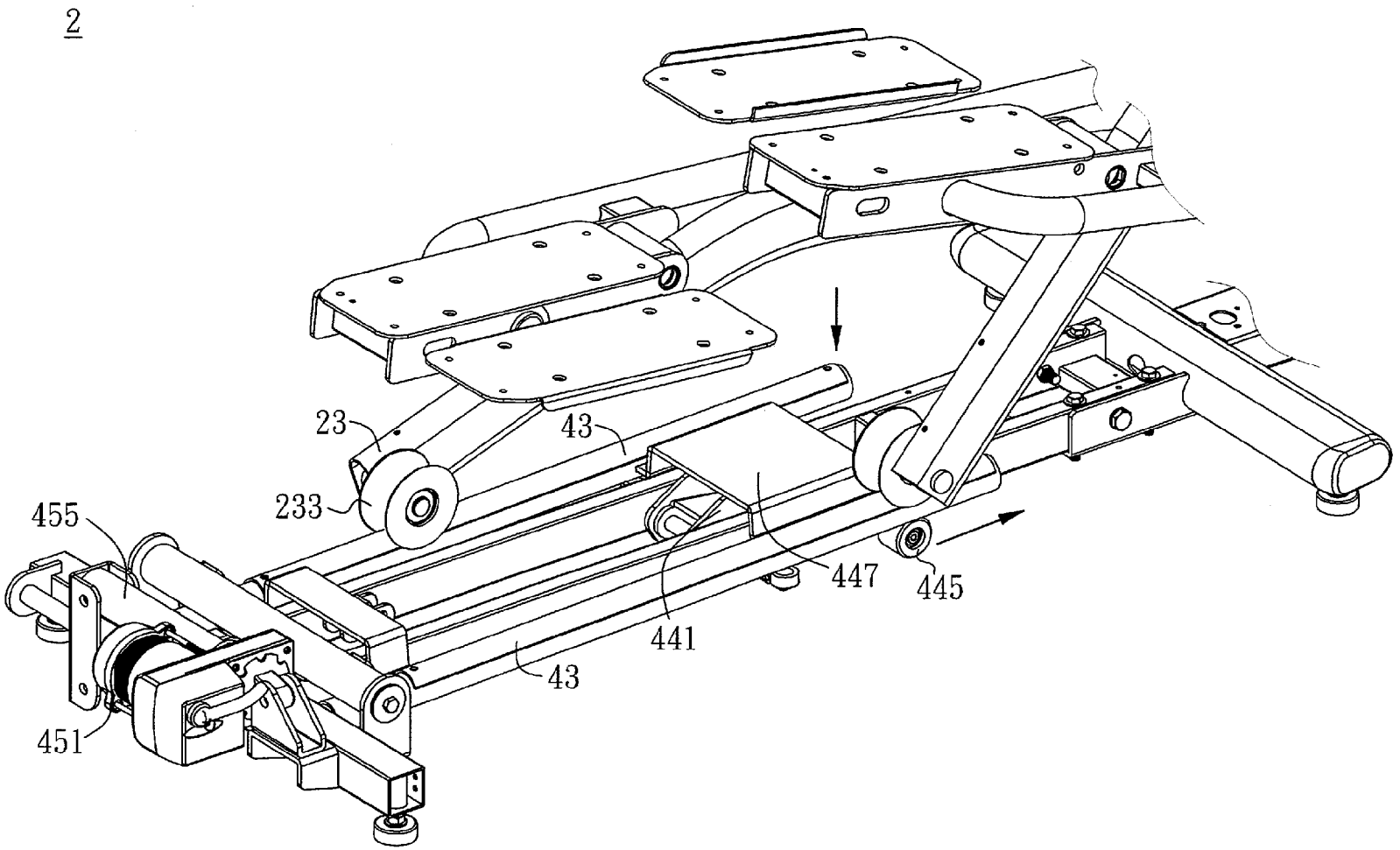
FIGS. 4A and 4B are respectively partially front enlarged view and partially bottom enlarged view, showing that the driving assembly draws the ladder component via the cable, to set the guiders at a lowest position.
Figure 4B:
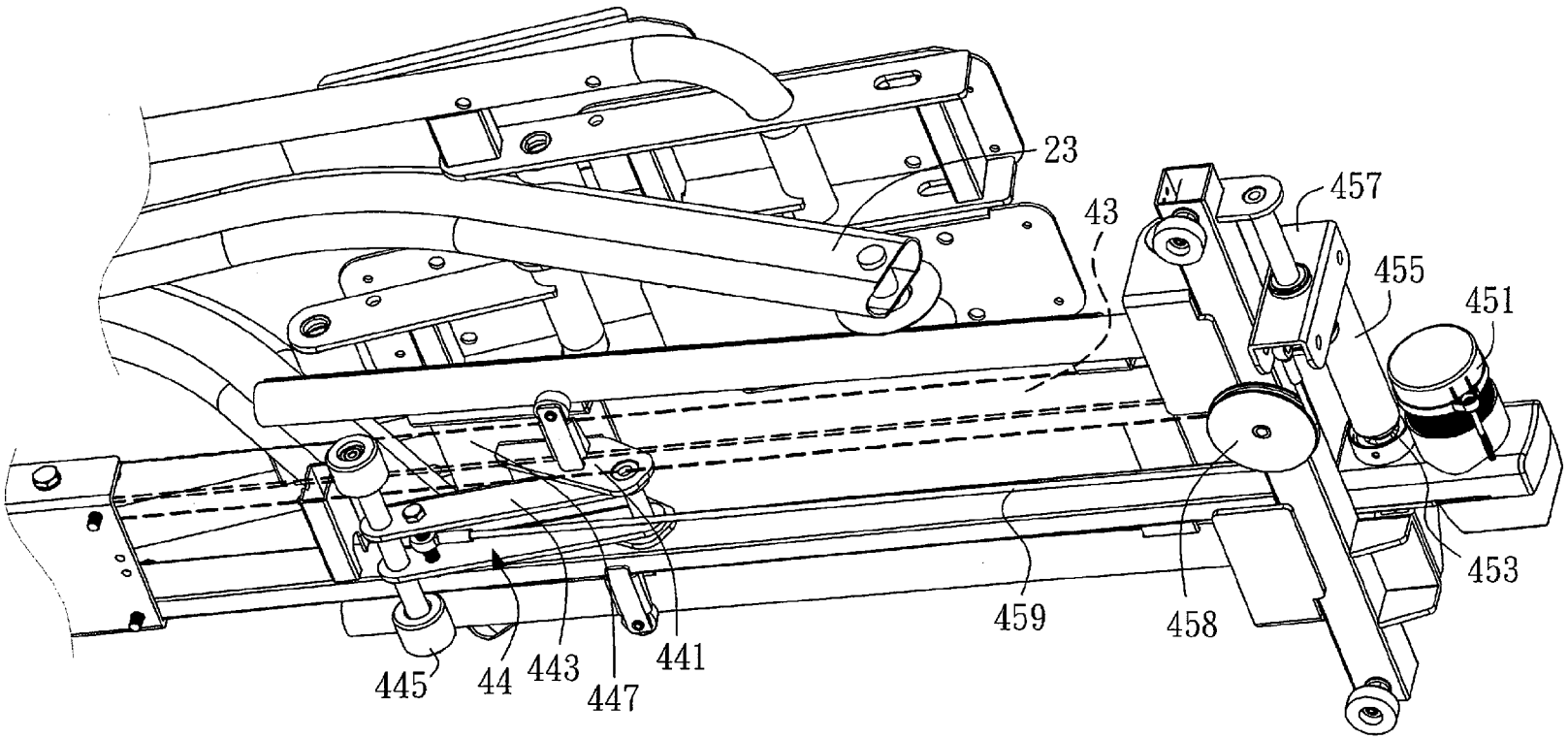

FIGS. 4A and 4B are respectively partially front enlarged view and partially bottom enlarged view, showing that the driving assembly 45 draws the ladder component 44 via the cable 459, to set the guiders 43 at a lowest position.

As shown in FIGS. 4A and 4B, when the motor 451 drives the screw 453 to rotate so as to make the tube 455 moving along the screw 453 in a direction approaching the motor 451, the tube 455 draws the cable 459 via the linkage component 457 and the cable 459 extends to make the wheel 445 moving to the front end of the elliptical trainer (as shown by arrow). Consequently, the ladder component 44 is folded and draws the coupled guiders 43 to the lowest position.

Figure 5A:
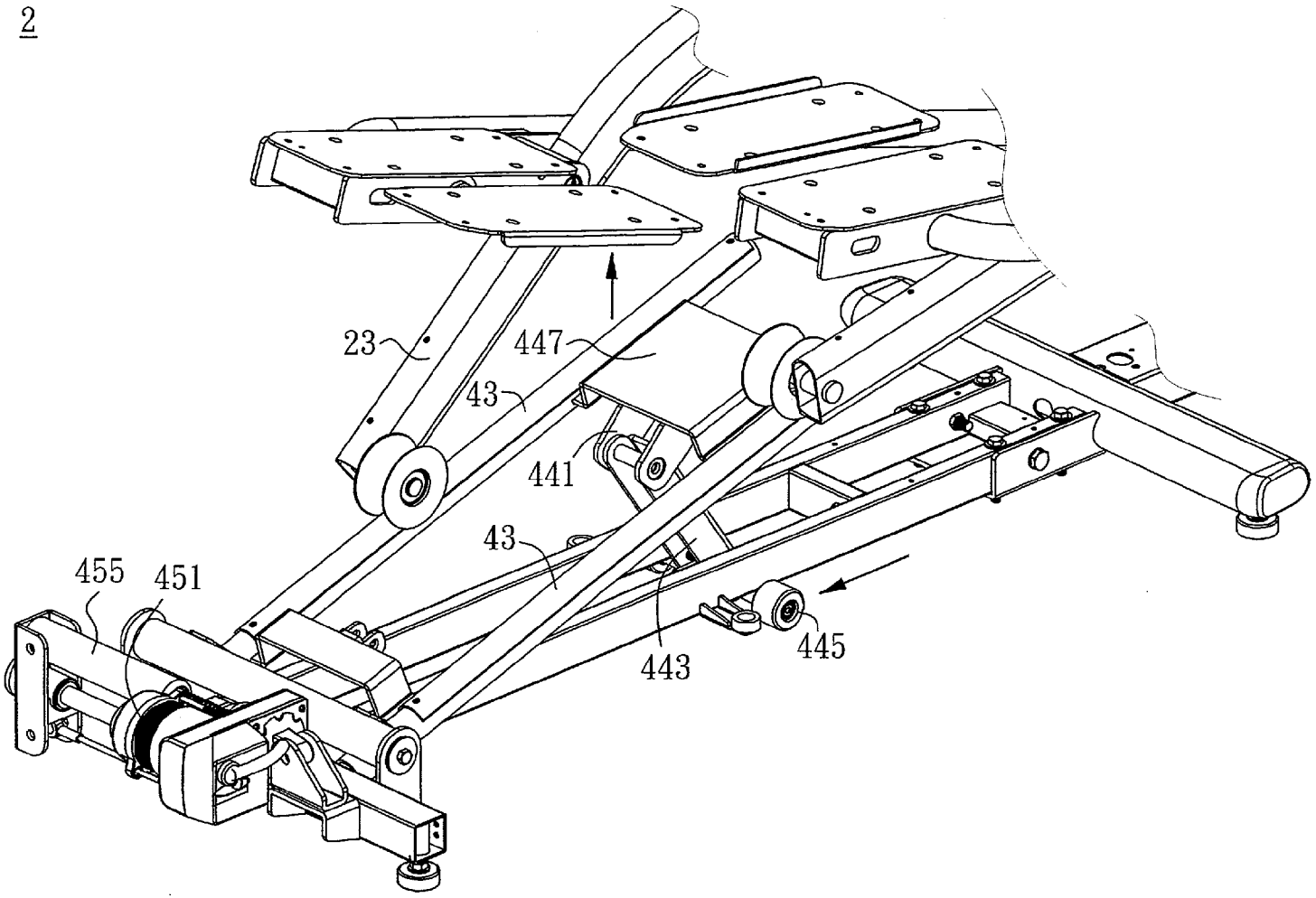
FIGS. 5A and 5B are respectively partially front enlarged view and partially bottom enlarged view, showing that the driving assembly draws the ladder component via the cable, to set the guiders at a highest position.
Figure 5B:
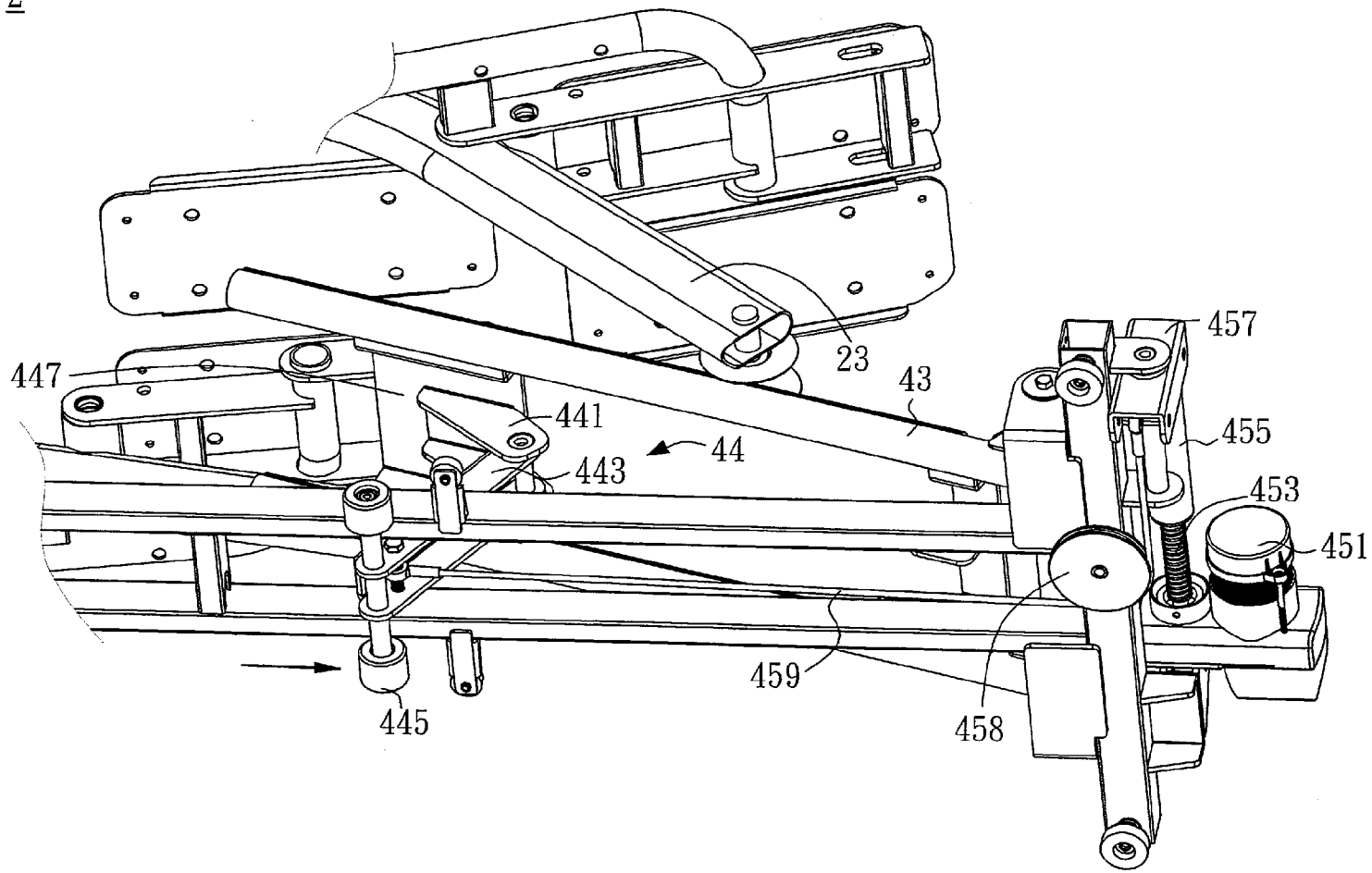

FIGS. 5A and 5B are respectively partially front enlarged view and partially bottom enlarged view, showing that the driving assembly 45 draws the ladder component 44 via the cable 459, to set the guiders 43 at a highest position.

As shown in FIGS. 5A and 5B, when the motor 451 drives the screw 453 to rotate so as to make the tube 455 moving along the screw 453 in a direction leaving the motor 451, the tube 455 draws the cable 459 via the linkage component 457 and the cable 459 draws the wheel 445 moving to the rear end of the elliptical trainer (as shown by arrow). Consequently, the ladder component 44 is unfolded and lifts the coupled guiders 43 to the highest position.

By precise control, the driving assembly 45 can set the guiders 43 at a level between the above-mentioned highest position and the lowest position. The variety of the moving path of the pedals 25 therefore can be achieved.

Notice that the number of the ladder component 44 of the foregoing embodiment can be deemed as two, and each ladder component 44 has a first portion 441 couples with the guiders via the U-shaped structure 447. In another embodiment of this invention, the first portion 441 of each ladder component 44 may directly couples with one guider 43. In another embodiment, the number of the ladder component 44 can be single and is arranged at inside or outside of the frame 41.

Accordingly, the embodiments of the present invention provide elliptical trainer with a novel rising device, which can control the guiders at a level between a highest position and a lowest position, so as to alter the moving path of the pedals. The novel rising device features in low material cost and stable structure. Further, the components of the driving assembly will not within the frame when the guiders are lowered down. Therefore, the components of the driving assembly have an arrangement convenient to maintain.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. An elliptical trainer, comprising:

a base;

a rotational mechanism mounted on the base;

a left coupling mechanism and a right coupling mechanism respectively arranged at a side of the rotational mechanism with one end coupled to the rotational mechanism and another end coupled to a left pedal and a right pedal to make a moving path; and a rising device comprising a frame, two guiders, at least one ladder component, and a driving assembly, wherein: the driving assembly comprises a motor, a screw, a tube, a linkage component, and a cable; the tube has an internal thread engaged with the screw; each ladder component comprises one end coupled with one of the two guiders and another end with a wheel contacting a supporting surface or ground; the linkage component couples with the tube; and the cable couples with the linkage component and the at least one ladder component.

2. The elliptical trainer of claim 1, wherein the rising device further comprises a pivot bracket disposed near to a rear end of the frame, and the pivot bracket has a pivot pivotally coupled with an end of each of the two guiders.

3. The elliptical trainer of claim 1, wherein the cable is made of steel, and when the motor drives the screw to rotate so as to make the tube move along the screw in a direction approaching the motor, the tube draws the cable via the linkage component and the cable extends to make the wheel move to the front end of the elliptical trainer, and consequently the ladder component is folded and draws the coupled guiders to a lowest position.

4. The elliptical trainer of claim 1, wherein the cable is made of steel, and when the motor drives the screw to rotate so as to make the tube move along the screw in a direction leaving the motor, the tube draws the cable via the linkage component and the cable draws the wheel move to the rear end of the elliptical trainer, and consequently the ladder component is unfolded and lifts the coupled guiders to a highest position.

5. The elliptical trainer of claim 1, wherein the at least one ladder component is arranged inside of the frame.

6. The elliptical trainer of claim 1, wherein the at least one ladder component is arranged outside of the frame.

7. The elliptical trainer of claim 1, wherein the at least one ladder component comprises two ladder components arranged inside of the frame.

8. The elliptical trainer of claim 7, wherein each ladder component comprises a first portion and a second portion, the first portion has two ends in which one end couples with one of the two guiders and the other end pivotally couples with the second portion, the second portion comprises a wheel, and the cable has two ends respectively coupling with the second portion and the linkage component.

9. The elliptical trainer of claim 8, wherein the rising device further comprises a U-shaped structure, and the first portion of each ladder component couples with one of the two guiders via the U-shaped structure.

10. The elliptical trainer of claim 1, wherein the driving assembly further comprises at least a disk arranged between the linkage component and the ladder component for changing the direction of the cable.

* * * * *